US006043612A

United States Patent [19]

Knobloch et al.

[11] Patent Number: 6,043,612

[45] Date of Patent: Mar. 28, 2000

[54] ELECTRONIC BALLAST WITH AUTOMATIC RESTARTING

[75] Inventors: Gert Knobloch, Pluederhausen; Peter Haaf, Schorndorf, both of Germany

[73] Assignee: Vossloh-Schwabe GmbH, Urbach, Germany

[21] Appl. No.: 09/055,974

[22] Filed: Apr. 7, 1998

[30] Foreign Application Priority Data

Apr. 12, 1997 [DE] Germany ..... 197 15 341

[51] Int. Cl.[7] ..... H05B 37/02

[52] U.S. Cl. ..... 315/224; 315/209 R; 315/291; 315/307; 315/119; 315/DIG. 7

[58] Field of Search ..... 315/224, 307, 315/360, 308, 291, 209 R, 119, 128, 247, DIG. 4, DIG. 5, DIG. 7

[56] References Cited

U.S. PATENT DOCUMENTS

| | | | |
|---|---|---|---|
| 4,710,682 | 12/1987 | Zuchtriegel | 315/224 |
| 5,315,214 | 5/1994 | Lesea | 315/209 R |
| 5,422,548 | 6/1995 | Yamashita et al. | 315/308 |
| 5,521,467 | 5/1996 | Statnic et al. | 315/247 |
| 5,705,894 | 1/1998 | Krummel | 315/119 |

FOREIGN PATENT DOCUMENTS

| | | |
|---|---|---|
| 0 239 793 | 10/1987 | European Pat. Off. . |
| 0 285 049 | 10/1988 | European Pat. Off. . |
| 0 687 135 | 12/1995 | European Pat. Off. . |
| 0 727 921 | 8/1996 | European Pat. Off. . |
| 42 43 955 | 6/1994 | Germany . |
| 44 10 492 | 9/1995 | Germany . |

OTHER PUBLICATIONS

G. Calabrese et al., "ST. SGS–Thompson Microelectronics; Application Note", *The L6569: A New High Voltage IC Driver For Electronic Lamp Ballast*, pp. 1–14, (1996).

*Primary Examiner*—Haissa Philogene
*Attorney, Agent, or Firm*—Foley & Lardner

[57] ABSTRACT

In an externally controlled electronic ballast, a driving circuit which requires a dedicated supply voltage is provided for the purpose of driving an inventor half bridge. The driving circuit is constructed such that the inventor half bridge blocks when the supply voltage $V_{cc}$ falls below a threshold value UVLO. Via a self-holding controllable electronic switch and a Z diode DZ2, a voltage monitoring circuit draws the supply voltage $V_{cc}$ below the threshold value UVLO when an excessively high lamp voltage is detected. The ballast is thereby inactive. A current sensing path which leads via at least one filament of the low-pressure gas discharge lamp serves to detect a change of lamp. The current sensing path controls a further electronic switch, which is likewise connected to the supply voltage $V_{cc}$ of the driving circuit and can, when it conducts, draw said voltage further to frame than the first switch. The second electronic switch connected to the current sensing path thus permits automatic restarting of the ballast after the change of lamp by bringing the first switch into a non-conductive state again by firstly further lowering the supply voltage $V_{cc}$ below the value prescribed by said switch.

18 Claims, 2 Drawing Sheets

ELECTRONIC BALLAST WITH AUTOMATIC RESTARTING

FIELD OF THE INVENTION

The invention relates to an electronic ballast having the features of the preamble of Patent claim 1. In particular, the invention relates to an externally controlled ballast having an inventor whose frequency is prescribed by a controlled oscillator.

BACKGROUND OF THE INVENTION

For the purpose of operating low-pressure gas discharge lamps, increasing use is being made of ballasts which not only start the relevant gas discharge lamp and supply it with the required voltage and the desired current, but also monitor the operation of the lamp. For example, DE 44 10 492 A1 has disclosed an electronic ballast having a freely oscillating inverter, the operation of which in stopped when a maximum lamp voltage is exceeded. For this purpose, there is connected to the terminal of the discharge lamp to which AC voltage is applied a voltage divider whose output is connected via a four-layer diode to the gate of a thyristor. The thyristor is connected to a base terminal of the inventor half bridge and blocks the inventor when it is started. If the voltage present across the gas discharge lamp exceeds a threshold value, the thyristor thereby turns the inventor off. The thyristor is supplied with current from the intermediate circuit voltage via a resistor, and thus is held in the conducting state. An at least brief disconnection of the ballast from the power system is necessary for the purpose of restarting the electronic ballast after a change of lamp. However, automatic restarting is frequently desired, that it to say after a change of lamp the electronic ballast is to be operationally ready again without further measures, and the low-pressure gas discharge lamp is to be supplied with current or voltage.

For this purpose, EP 0 239 793 B1, for example, has disclosed a circuit of a freely oscillating electronic ballast in which the defective behavior, leading to increased lamp voltages, of a gas discharge lamp is detected via the increased voltage drop across a resonance inductor which is connected in series with the lamp. The resonance inductor is coupled to a secondary winding which is connected via a trigger circuit to the gate electrode of a thyristor. In the case of a fault, the latter earths the base of an inventor transistor in order to switch the inventor circuit to be inactive. The thyristor is supplied with a holding current from the intermediate circuit voltage via a resistor combination. After a change of lamp, said current is briefly taken over by a commutation capacitor which is charged up to the intermediate circuit voltage via a resistor by means of a terminal with the lamp taken out. When a lamp is inserted, its filament switches the charged terminal to frame, the capacitor briefly taking over with its other terminal the current flowing through the thyristor, with the result that said thyristor is turned off and the generator circuit can restart.

Said circuit is freely oscillating control circuit.

In order to be able to undertake as precise as possible a setting of the power converted at the lamp, or of the voltage present and of the current flowing, and to avoid reactions of properties of the gas discharge lamp on the operation of the ballast, there is a trend toward externally controlled ballasts which operate at a prescribed frequency. Such a ballast is disclosed, for example, in EP 0 727 921 A2. The electronic ballast contains a generator circuit for generating a lamp AC voltage, it being possible for the generator circuit to be stopped operating via a control input. Connected to the latter is a voltage monitoring unit which turns off the generator circuit when a maximum voltage across the lamp is exceeded. In more concrete terms, an appropriate generator circuit is disclosed in the application details for the L 6569 of SGS Thomson Microelectronics. The generator described there has control terminals for controlling an inventor half bridge, and operates at an operating voltage of, for example, 15 volts. If this operating voltage is lowered below a prescribed threshold value UVLO, the circuit blocks the connected inventor half bridge. The operating voltage can be lowered via a thyristor, which is then further supplied with the holding current from the intermediate circuit voltage.

In order to restart the circuit, the latter must be disconnected from the power system until the holding current has decayed and the thyristor has become free.

SUMMARY OF THE INVENTION

Starting therefrom, it is the object of the invention to create an electronic externally controlled ballast which is turned off in the case of a defective lamp and automatically restarts after a change of lamp.

This object is achieved by means of an electronic ballast having the features of Patent claim 1.

The electronic ballast has a half bridge which is controlled by a driving circuit and to whose output one or more low-pressure gas discharge lamps are connected. In the case of a plurality of gas discharge lamps, the latter are connected in series. The driving circuit fixes the frequency at which the inventor half bridge operates, thus largely excluding or reducing interference effects on the operating frequency as a consequence of tolerance in the lamp parameters.

The driving circuit is supplied with a supply voltage which can be lowered via a controlled switch with a self-holding characteristic to a value which falls below a threshold value UVLO (undervoltage lockout). The controlled switch is controlled by a monitoring circuit for the lamp voltage. If the lamp voltage exceeds a permissible measure, this is evaluated as an indication that the lamp is defective, and the controlled switch lowers the operating voltage of the driving circuit below UVLO.

The second controlled switch, which is likewise connected to the supply voltage of the driving circuit can, when it is activated, lower said voltage even further. In order to ensure this, a circuit generating a fixed potential offset is connected in series with the first controlled switch. Said circuit can, for example, be a Z diode, with the result that upon activation of the first switch the supply voltage collapses to the Z voltage, for example. Only if it is activated does the second controlled switch lower the supply voltage below this Z voltage, as a result of which the self-holding switch is deenergized and thus blocked. The second controlled switch is activated by a monitoring circuit which has a sensor circuit which leads via at least one lamp filament. If the filament is broken or the lamp is withdrawn (for example disconnected from the electronic ballast), the second switch is activated, as a result of which the operation of the electronic ballast is stopped, as previously. However, the first self-holding switch, which has undertaken to turn off the overvoltage, is blocked again. If an intact lamp is now connected to the ballast, the second switch is blocked via the current path leading via the heater coil, and the driving circuit again receives its full supply voltage. It now drives the inventor half bridge in such a way that the inserted lamp is started and burns.

The lowering of the supply voltage of the driving circuit to a relatively large non-zero value below the threshold voltage UVLO for the purpose of inactivation permits the self-holding first switch to block again without the need for the second controlled switch to be completely switched through (rendered of very low resistance). It suffices if said second switch merely lowers the potential somewhat further. The corresponding monitoring circuit can therefore be designed with the relatively high resistance, and this reduces reactions on the low-pressure gas discharge lamp and the required power loss.

If the first controlled switch is formed by a circuit formed by two transistors of different conductivity type, as said circuit is named in claim 2, very low holding currents are rendered possible, and this minimizes the power loss in a supply resistor leading to the intermediate circuit voltage. Moreover, a cost-effective solution results. If required, however, it is also possible to use an appropriately selected thyristor.

The circuit generating an essentially fixed potential offset can be formed by a Z diode or another type of component, which has a comparable characteristic. It is sufficient in this case if the potential offset generated is approximately constant, as is the case, for example, when the dynamic resistance of the component is not zero but relatively low.

The second controlled switch is preferably a pnp transistor connected as an emitter follower, whose base is connected to frame in a high-resistance fashion. Moreover, the base is connected to a sensor circuit which is led by means of high-resistance series resistors via at least one filament of the gas discharge lamp. If this sensor circuit is interrupted, the low current flowing to frame via the base series resistor of the transistor suffices to convert said circuit from its blocking state into a state in which it conducts and takes over the holding current of the thyristor. In this case, the transistor need not be fully switched through or even be saturated. This yields a very low-power circuit.

Fixing the time constants in accordance with claim 17 is advantageous particularly in the case of two-flame operation. It is ensured thereby that in the case of faults in which one or both gas discharge lamps go over to rectifier operation the first switch closes reliably without being turned off again by the second switch.

BRIEF DESCRIPTION OF THE DRAWINGS

Further details of advantageous embodiments of the invention are the subject-matter of the subclaims, and follow from the description of exemplary embodiments as well as associated drawings. Exemplary embodiments of the invention are represented in the drawing, in which:

DETAILED DESCRIPTION OF THE INVENTION

Figure 1:
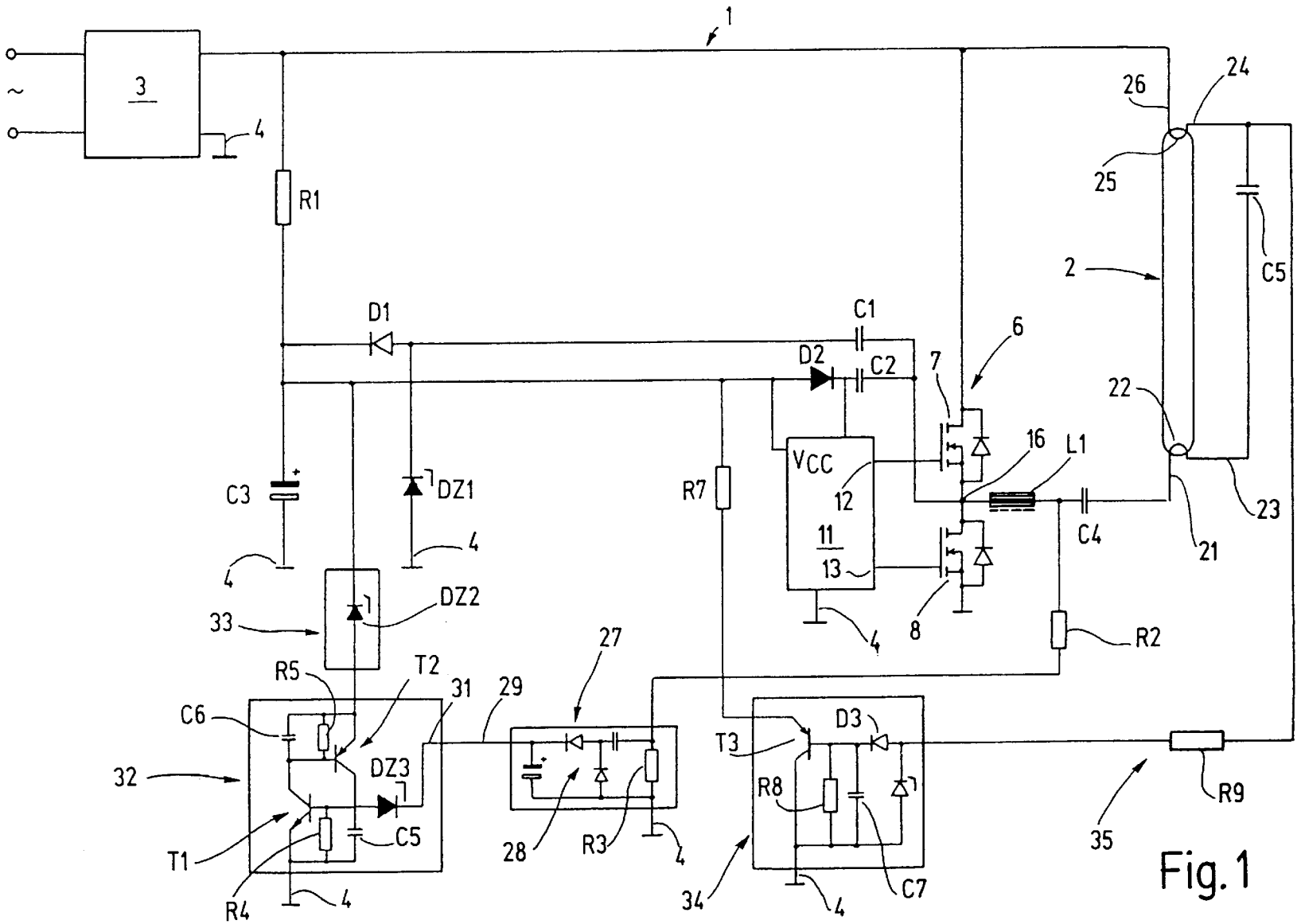
FIG. 1 shows an electronic ballast according to the invention for single-lamp operation, in a diagrammatic representation of its circuit, circuit paths not essential to the invention having been omitted.

Represented in the block diagram in FIG. 1 is an electronic ballast 1 that serves to operate one or more low-pressure gas discharge lamps 2. The electronic ballast 1 has a system rectifier and transformer circuit 3 which supplies an intermediate circuit voltage of approximately 400 volts against frame 4. In order to generate the symmetrical AC voltage required to operate the low-pressure gas discharge lamps 2 from the intermediate circuit voltage, use is made of an inventor half bridge 6 which is formed in the present example by two MOSFETs 7, 8. The inventor half bridge 6 is connected between the intermediate circuit voltage and frame 4.

In order to drive the invert or half bridge 6, use is made of a driving circuit 11, which preferably contains an integrated circuit such as, for example, the L 6569 of SGS-Thomson and has two output terminals 12, 13 connected to the gates of the MOSFETs 7, 8. The integrated circuit of the driving circuit 11 is provided with an external circuit (not represented in more detail) which sets a specific operating frequency. This means that driving signals for the MOSFETs 7, 8 are present at the output terminals 12, 13 in a push-pull fashion at a given frequency in such a way that the MOSFETs 7, 8 open or are switched on alternately, but not in an overlapping fashion.

The driving circuit 11 has a supply voltage terminal $V_{cc}$, via which it is provided with supply voltage and, simultaneously, with information on whether it is to drive or block the MOSFETs 7, 8: if the supply voltage $V_{cc}$ exceeds a fixed threshold value UVLI (undervoltage locking, the driving circuit 11 alternately turns the MOSFETs 7, 8 on and off with a frequency which is prescribed by the external circuit. If the supply voltage $V_{cc}$ falls below the threshold value UVLO, the two MOSFETs 7, 8 are blocked.

The supply voltage is generated when the electronic ballast 1 is running, that is to say the low-pressure gas discharge lamp 2 glows from the square-wave voltage generated by the inventor half bridge 6. This purpose is served by two capacitors C1 and C2, which are both connected to in each case one terminal by a connecting point 16 which forms the output of the inventor half bridge 6. The connecting point 16 is formed by the connection of source and drain of the MOSFETs 7, 8. Via the diodes D1, D2 connected in series with the capacitors C1 and C2, charge packets are pumped at the inventor frequency of approximately 30 kHz to a smoothing or buffer capacitor C3, which is connected to frame 4 and from which the supply voltage is led to the corresponding supply voltage terminal of the driving circuit 11. A voltage rise is prevented by a Z diode DZ1, which is connected to the anode of D1 and to frame with its own anode.

In order to permit the supply voltage for the driving circuit 11 to be generated even before the inventor half bridge 6 is driven and inverted, a resistor R1 is provided which is connected with one end to the interediate circuit voltage and with the other end to the capacitor C3. The capacitor C3 is charged with a low current via the resistor R1 until the voltage across the capacitor C3 exceeds the threshold voltage UVLI and the driving circuit 11 starts up.

The gas discharge lamp 2 to be operated by the electronic ballast 1 is connected directly, via a resonance reactor L1 and a coupling capacitor C4, to the connecting point 16 which forms t he output of the inventor half bridge 6 and is switched to and fro between the intermediate circuit voltage and frame at the frequency prescribed by the driving circuit 11. The series circuit of the resonance reactor L1 and the coupling capacitor C4 is connected via a lamp holder (not represented in more detail) to a terminal 21 of the gas discharge lamp 2. The terminal leads outward via a filament 22 situated in the gas discharge lamp 2 to a terminal 23 which is connected via a resonance capacitor C5 to a further terminal 24 of the gas discharge lamp 2, which is led to a filament 25 and, via the latter, to a terminal 26 which is connected to the intermediate circuit voltage.

While the resonance reactor L1 and the resonance capacitor C5 form a series resonant circuit which causes a voltage, which can exceed the intermediate circuit voltage, to drop across the gas discharge lamp 2 in the case of undamped resonance, the coupling capacitor C4 is used merely to isolate the gas discharge lamp 2 in terms of direct current from the inventor half bridge 6, with the result that the lamp current contains no direct component.

For the purpose of monitoring the voltage dropping across the gas discharge lamp 2, use is made of a voltage monitoring circuit 27 which is connected via a high-resistance resistor R2 to the lamp-side end of the resonance reactor L1. On the input side, the voltage monitoring circuit 27 further contains an input resistor R3, which forms a voltage divider with the resistor R2 and is connected to frame 4. Connected downstream of the input resistor R3 is a voltage doubler connection 28 which outputs at its output 29 a DC voltage signal which corresponds to the lamp voltage. The output 29 is connected to a control input 31 of a first controllable switch 32 which is connected with one end to frame 4. Its other end is connected via a voltage offset circuit 33 to the supply voltage of the driving circuit 11. The switch 32 is formed by an pnp transistor T1 and a npp transistor T2. The emitter of T1 is connected to frame 4, and its collector is connected to the base of T2. The collector of T2 is connected to the base of T1 which, in addition, is connected to frame 4 via a resistor R4 and a capacitor C5. The base of T2 is connected to its emitter via a resistor RS and a capacitor C6. The transistors T1 and T2 form a bistable circuit which either assumes a non-conducting state in which the path from the emitter of the transistor T2 to the emitter of the transistor T1 is blocked (blocking state) or conducts (conducting state). By means of a voltage signal at the control input 31, the switch 32 is converted via a Z diode DZ3 from its blocking state into its conducting state, which is maintained until a low holding current, which can be set by the resistors R4, R5, is fallen below. In the conducting state, the emitter of the transistor of T2 is virtually at frame 4.

The voltage offset circuit 33, which is formed in the simplest case by a Z diode DZ2, has a voltage drop which is less than the threshold voltage UVLO. The driving circuit 11 is thereby deactivated when the switch 32 conducts. If the voltage monitoring circuit 27 detects an excessively high voltage across the gas discharge lamp 2, it switches the switch 32 into its conducting state, as a result of which the latter blocks the driving circuit 11 by lowering the supply voltage $V_{cc}$ below UVLO.

In order to permit restarting after changing the lamp, the supply voltage $V_{cc}$ is additionally connected via an optional resistor R7 to a controllable switch 34 which is connected to frame 4. The switch 34 need not be a switch in the binary sense, but has a nonconducting state in which the current path from the resistor R7 to frame 4 is blocked, as well as a further state in which a certain flow of current is permitted, it being entirely possible for the internal resistance of the switch 34 still to have a relatively high value.

The switch 34 is formed by a circuit whose main part is an pnp transistor T3. Its emitter is connected to the resistor R7, and its collector is connected to frame 4. Its base is connected to frame via a resistor R8 and the capacitor C7. The resistor R8 forms a base series resistor, which sets a base current which is dimensioned such that the resulting emitter current is higher than the current supplied by the resistor R1 and absorbed by the switch 32. Via a damping diode D3, the base of the transistor T3 is connected to a current sensing path 35 which contains a resistor R9 and leads to the terminal 24. From the latter, the current sensing path goes via the filament 25 to the intermediate circuit voltage. If the current sensing path 35 is interrupted at any point, for example by virtue of the fact that the gas discharge lamp 2 is taken out of its holder and thus the path from the terminal 26 to the terminal 34 is interrupted, the transistor T3 obtains base current via the resistor R8. In this case, the transistor T3 is turned on to the extent that it can take over the current delivered by R1 via the resistor R7. If, by contrast, a gas discharge lamp 2 is inserted into the holder, the potential at the base of the transistor T3 increases so far that said transistor supplies at its emitter a voltage which is higher than the supply voltage $V_{cc}$, as a result of which the switch 34 does not conduct, that is to say is open.

The electronic ballast 1 so far described operates as follows, in particular as regards restarting in the case of a change of lamp:

During correct operation of the gas discharge lamp 2, there is available as supply voltage $V_{cc}$ for the driving circuit 11 a voltage which exceeds the threshold voltage UVLO. The inventor half bridge 6 provides an AC voltage by means of which the low-pressure gas discharge lamp 2 is started and operated. Via the resistor R2, the voltage monitoring circuit 27 detects a voltage which is lower than a prescribed maximum value. Consequently, the voltage present at the control input 31 of the switch 32 does not exceed a starting voltage which would be required in order to switch the switch 32 to a low resistance. However, if the low-pressure gas discharge lamp 2 exhibits a fault which causes the operating voltage to rise impermissibly, this is detected by the voltage monitoring circuit 27, and the switch 32 is started by a signal at its control input 31. It thereby becomes of low resistance and connects the anode of the Z diode DZ2 to frame 4. The supply voltage $V_{cc}$ therefore drops to a value below the threshold voltage UVLO, as a result of which the driving circuit 11 completely blocks the inventor half bridge 6. This state is maintained by the self-holding nature of the switch 32. A corresponding self-holding current is supplied via the resistor R1 from the intermediate circuit voltage.

As long as the defective low-pressure gas discharge lamp 2 is inserted into the holder and thus remains connected to the ballast 1, a low current flows via the filament 25 and the current sensing path 35 to the base of the transistor T3, as a result of which the latter blocks as before. However, if the filament 25 has a break, or if the gas discharge lamp 2 is taken out of the holder, the current sensing path is interrupted, as a result of which the transistor T3 is more or less turned on and the potential at the supply voltage input of the driving circuit 11 drops further below the potential prescribed by the Z diode DZ2. The switch 32, which obtains no more holding current, blocks as a result. However, the driving circuit 11 remains inactive as before. Not until a gas discharge lamp 2 has been connected again to the ballast 1, that is to say is inserted into the relevant lamp holder, is the current sensing path 35 closed and the transistor T3 turned off, that is to say the switch 34 is opened. As a result, the supply voltage $V_{cc}$ can be built up again via the resistor R1, the ballast 1 thereby assuming its normal operation.

Figure 2:
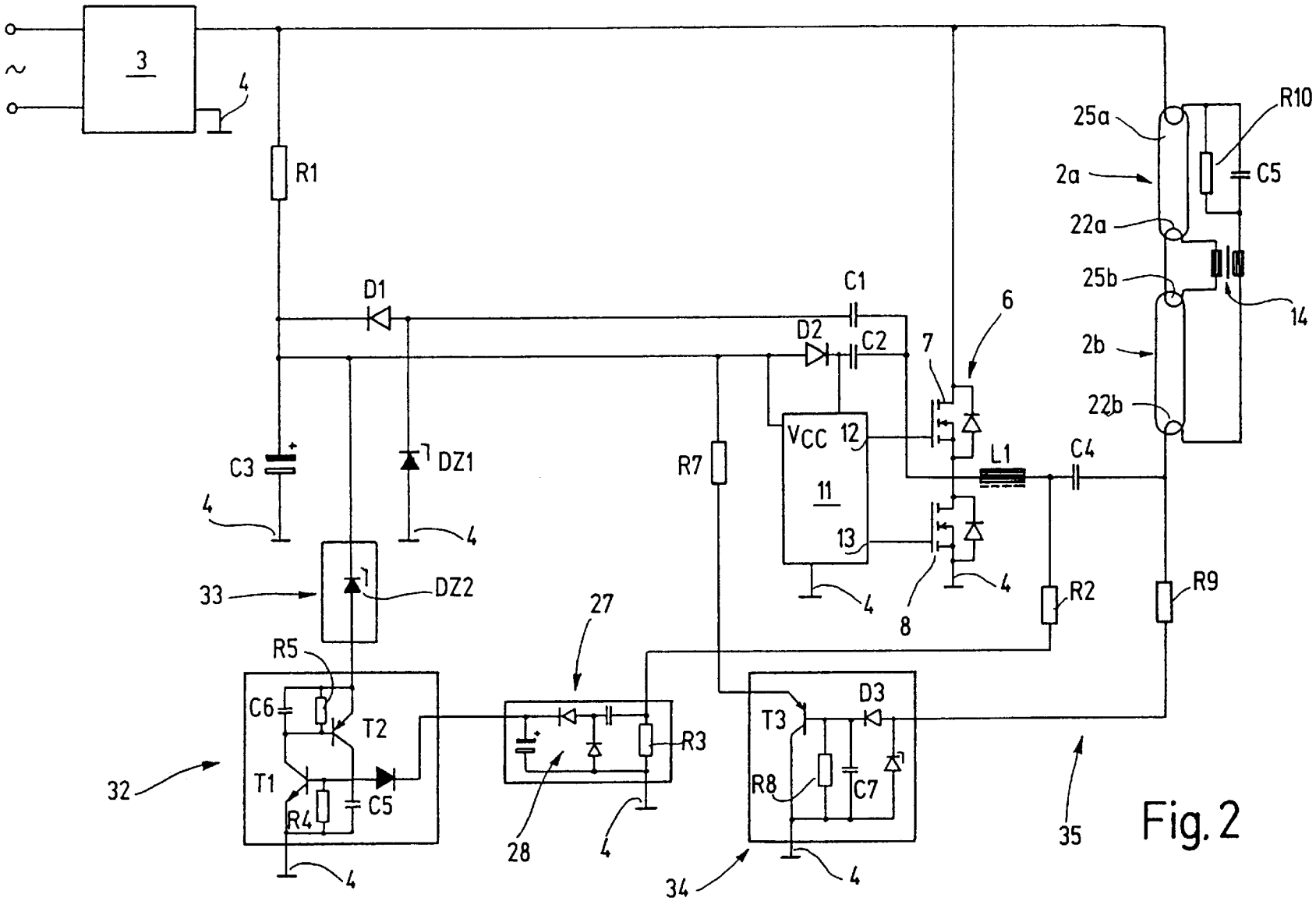
FIG. 2 shows an electronic ballast according to the invention for the operation of two series-connected low-pressure gas discharge lamps, in a simplified block diagram, circuit parts not essential to the invention likewise having been omitted.

A further exemplary embodiment of the invention is illustrated in FIG. 2. To the extent that there is correspondence, the same reference symbols are used without renewed description and reference, the description applying correspondingly. The difference from the ballast 1 previously described resides only in the fact that two series-connected gas discharge lamps 2*a*, 2*b* are provided instead of the low-pressure gas discharge lamp 2. Their mutually connected filaments 22*a*, 25*b* are heated via a transformer M, which is connected in series with the resonance capacitor C5. Moreover, the current sensing path 35 leads via the winding of the transformer M which is connected in series with the resonance capacitor C5. In order to close the high-resistance current sensing path, a resistor R10 is connected in parallel with the capacitor C5 and is, like all resistors which are exposed to relatively large voltage differences, formed in practice by a series circuit of individual resistors.

In an externally controlled electronic ballast 1, a driving circuit 11 which requires a dedicated supply voltage is provided for the purpose of driving an inventor half bridge 6. The driving circuit 11 is constructed such that the inventor half bridge 6 blocks when the supply voltage $V_{cc}$ falls below a threshold value UVLO. Via a self-holding controllable electronic switch 32 and a Z diode DZ2, a voltage monitoring circuit 27 draws the supply voltage $V_{cc}$ below the threshold value UVLO when an excessively high lamp voltage is detected. The ballast is thereby inactive. A current sensing path 35 which leads via at least one filament of the low-pressure gas discharge lamp 2 serves to detect a change of lamp. The current sensing path controls a further electronic switch 34, which is likewise connected to the supply voltage $V_{cc}$ of the driving circuit 11 and can, when it conducts, draw said voltage further to frame than the first switch 32. The second electronic switch 34 connected to the current sensing path 35 thus permits automatic restarting of the ballast 1 after the change of lamp by bringing the first switch 34 into a non-conductive state again by firstly further lowering the supply voltage $V_{cc}$ below the value prescribed by said switch 32.

What is claimed is:

1. An electronic ballast (1) for operation of low-pressure gas discharge lamps (2), comprising:

a DC voltage source (3) which serves to supply current to at least one gas discharge lamp (2), which has two filaments (22,25) as electrodes;

at least one half bridge (6), which is connected to the DC voltage source (3) and supplies an AC voltage at an output terminal (16), wherein said output terminal (16) is connected to the at least one gas discharge lamp (2) via coupling means (L1, C4);

a driving circuit (11), which is provided for the half bridge (6), is connected via control terminals (12, 13) to the half bridge (6) and drives the latter at a settable frequency, and which has a supply voltage input connected to a supply voltage (Vcc);

wherein when the supply voltage exceeds a threshold value (UVLO) the driving circuit (11) adopts an active operating mode in which it drives the half bridge (6) at a given frequency, and wherein when the supply voltage (Vcc) falls below the threshold value (UVLO) the driving circuit (11) adopts a passive operating mode in which the half bridge (6) blocks;

a first controlled switch (32) with a self-holding characteristic which is connected to the supply voltage (Vcc) against frame (4), in order to reduce said voltage below the threshold value (UVLO) when it is closed, wherein the first controlled switch (32) is connected in series with a circuit (33) generating an essentially fixed potential offset when the switch (32) is closed, and is closed by a first monitoring circuit (27) which detects an impermissible state at the at least one gas discharge lamp (2), with the result that the supply voltage (Vcc) is lowered to below the threshold value (UVLO) but not to zero, and wherein there is connected against frame (4) to the supply voltage (Vcc) a second controlled switch (34), which has a non-conducting and an at least limitedly conducting state and which is connected to a second monitoring circuit (35), which detects a flow of current through at least one filament (25) of the at least one gas discharge lamp (2), in such a way that the switch (43) lowers the supply voltage (Vcc) of the driving circuit (11) further than the first controlled switch (32) when no flow of current through the filament (25) is detected.

2. The electronic ballast according to claim 1, wherein the first controlled switch (32) is formed by a pnp transistor (T2) and an npn transistor (T1) whose base and collector are alternately connected to one another and whose emitters form the external connections of the switching path of the switch (32), one base forming a control input (31).

3. The electronic ballast according to claim 1, wherein the circuit (33) generating an essentially fixed potential offset is formed by a Z diode (DZ1).

4. The electronic ballast according to claim 3, wherein the Z diode (DZ1) has a breakdown voltage which is only slightly lower than the threshold value (UVLO).

5. The electronic ballast according to claim 1, wherein the first controlled switch (32) is a thyristor.

6. The electronic ballast according to claim 1, wherein the second controlled switch (34) is a transistor (T3).

7. The electronic ballast according to claim 6, wherein the second controlled switch (34) is a pnp transistor (T3) connected as an emitter follower, whose emitter is connected to the supply voltage (Vcc) and whose collector is connected to frame (4).

8. The electronic ballast according to claim 7, wherein the base of the emitter follower (T3) is connected against frame (4) to a high-resistance resistor (R8).

9. The electronic ballast according to claim 1, wherein the second monitoring circuit (35) for detecting the flow of current through at least one filament (25) of the at least one gas discharge lamp (2) is formed by a current path (35) which leads from the DC voltage source (3) via the at least one filament (25) and at least one high-resistance resistor (R9) to the control input of the second switch (34).

10. The electronic ballast according to claim 8, wherein the at least one high-resistance resistor (R9) is connected to the base of the transistor (T3).

11. The electronic ballast according to claim 1, wherein two gas discharge lamps (2*a*, 2*b*) are connected in series between the DC voltage source (3) and the half bridge (6).

12. The electronic ballast according to claim 1, wherein the gas discharge lamp (2) is connected to a voltage-raising series resonant circuit (L1, C5).

13. The electronic ballast according to claim 1, wherein the coupling element for connecting the gas discharge lamp to the half bridge is a coupling capacitor (C4) for suppressing DC components.

14. The electronic ballast according to claim 1, wherein for the purpose of monitoring the voltage across the gas discharge lamp (2) the first monitoring circuit (27) has a high-resistance current path (R2) which, starting from one end of a resonance reactor (L1), which is connected with its other end to the half bridge (6) leads to a resistor (R3) connected to frame (4), and forms a voltage divider (R2, R3) with said resistor.

15. The electronic ballast according to claim 14, wherein a rectifier circuit (28) is connected to the voltage divider (R2, R3).

16. The electronic ballast according to claim 15, wherein the rectifier circuit (28) has an outlet (29) which is connected to the control terminal (31) of the first controllable switch (32).

17. The electronic ballast according to claim 1, wherein the second switch (34) has a tarn-on time constant ($\tau 1$) which is greater than a turn-on time constant ($\tau 2$) of the first switch (27).

18. The electronic ballast according to claim 9, wherein the at least one high-resistance resistor (R9) is connected to the base of the transistor (T3).

* * * * *